United States Patent [19]

Allen et al.

[11] Patent Number: 4,921,592

[45] Date of Patent: May 1, 1990

[54] PROCESS FOR CONTROLLING FOULING OF CATALYST BEDS

[75] Inventors: Lynn M. Allen, Navasota; Don M. Taylor, League City; Charles D. Roberts, Conroe, all of Tex.

[73] Assignee: Amoco Corporation, Chicago, Ill.

[21] Appl. No.: 217,582

[22] Filed: Jul. 11, 1988

[51] Int. Cl.[5] ..... C10G 21/00

[52] U.S. Cl. ..... 208/48 AA; 585/950; 252/33; 208/48 R

[58] Field of Search ..... 208/48 AA; 585/950; 252/33, 47, 50

[56] References Cited

U.S. PATENT DOCUMENTS

| | | | |
|---|---|---|---|
| 3,224,957 | 12/1965 | Kent | 208/48 AA |
| 3,235,484 | 2/1966 | Colfer | 208/48 AA |
| 3,554,897 | 1/1971 | Stanley | 208/48 AA |
| 3,654,129 | 4/1972 | Bloch | 208/48 AA |
| 4,024,048 | 5/1977 | Shell et al. | 208/48 AA |

OTHER PUBLICATIONS

"Amoco Ultracracker is Performing Well", Frye et al., API Midyear Refining, vol. 68, May. 1970, pp. 69–71.

*Primary Examiner*—Glenn Caldarola

[57] ABSTRACT

A process for reducing the effects of catalyst bed fouling when a hydrocarbon feedstock is contacted with a catalyst at elevated temperatures comprising adding to the feedstock an effective amount of a higher hydrocarbyl amine, optionally in combination with an alkylarylsulfonic acid.

25 Claims, No Drawings

PROCESS FOR CONTROLLING FOULING OF CATALYST BEDS

FIELD OF THE INVENTION

The present invention relates to processes wherein a fixed bed of catalyst is contacted with a hydrocarbon-containing feedstock under conditions such that deposits foul the catalyst bed and restrict the flow of feedstock through the catalyst bed. More specifically the present invention relates to a method of controlling the fouling of the catalyst bed in such processes. In another specific aspect, the invention relates to a method for reducing the pressure drop across fouled beds of catalyst.

BACKGROUND OF THE INVENTION

The conversion of crude oil into the various products desired in the marketplace generally involves a series of process steps. Typically, distillation of the crude oil is followed by further processing for the purpose of producing gasoline, kerosene, jet fuel, and other fuels. Examples of some such processes include those generally referred to as hydroprocessing which includes those known as hydrocracking, ultracracking, hydroconversion, hydrorefining, reforming, and hydrodesulfurization and in general any process in which hydrogen is produced or consumed. Under the reaction conditions employed in such processes the bed of catalyst tends, over time, to become fouled with a layer of carbon and/or inorganic deposits, especially when the feedstock includes the heavier, more refractory fractions of the crude oil. The accumulation of such deposits tends to reduce the flow of the feedstock through the catalyst bed. It is often observed that the deposits cause such a restriction that, even though the catalyst is still active, it becomes difficult to introduce the feedstock into the reactor. The reaction then becomes pressure limited and thus even though the catalyst is still active, less hydrocarbon can be processed. If the restriction of flow becomes too great it can actually cause the catalyst bed to collapse, effectively stopping the process. Prior to such time, the process can be interrupted and at least the deposit fouled inlet portion of the catalyst bed can be removed and replaced.

The present invention provides a method for increasing the time that a catalyst can be employed effectively without having to interrupt the process.

The present invention also provides a process which will inhibit and suppress fouling of the catalyst bed by deposits.

Surprisingly, the present invention is also useful for reversing the flow restricting effects of deposits already existing on a previously used catalyst.

The present invention also provides a method of reducing the fouling of the catalyst bed by deposits without adversely affecting the catalytic properties of the catalyst to any significant degree.

The only process of which the present inventors are aware which claims to provide similar results is the process disclosed in U.S. Pat. No. 4,024,048, the disclosure of which is incorporated herein by reference. The process of that patent employs a treating agent comprising phosphite or phosphate esters. The treating agent employed in the present invention differs in that it does not require the presence of phosphite or phosphate esters.

BRIEF SUMMARY OF THE INVENTION

In accordance with the present invention there is provided a process for reducing the fouling of a catalyst bed that results from deposits that accumulate in or on the catalyst bed. The phrase "reducing the fouling" is used here in its broadest sense to include the reduction of the effects of deposits already present on a catalyst and/or the suppression of the formation of undesirable deposits. The "fouling" that is being referred to is the blocking of the catalyst bed which leads to increased pressure drop across the catalyst bed and not merely the formation of deposits on the catalyst.

The process of the present invention involves contacting the catalyst bed with an effective amount of an antifoulant composition comprising at least one amine. The term amine as used herein refers to organic compounds of nitrogen which may be considered as derived from ammonia ($NH_3$) by replacing one or more of the hydrogen atoms with alkyl groups. The term amine is used herein in its ordinary technical sense. The term "essentially an amine" therefore excludes those compositions in which an amine is complexed with phosphate esters or phosphite esters as defined in U.S. Pat. No. 4,024,048, column 2, line 9-column 3, line 22.

DETAILED DESCRIPTION OF THE INVENTION

It is considered that the invention will have a wide range of applications. Accordingly, typical processes to which the invention can be applied should include hydrotreating, hydrocracking, ultracracking, reforming, hydroprocessing, hydroconversion, hydrorefining, and hydrodesulfurization. The invention has been found to be particularly useful in hydrocracking, often referred to as ultracracking, a process described in some detail by C. G. Frye, D. L. Muffet, and H. W. McAninch, *Oil & Gas J.* 68(20), 69–71 (1970), the disclosure of which is incorporated herein by reference. The invention has also been found to be particularly useful in hydrodesulfurization.

As indicated, the present invention is particularly useful in processes using the higher boiling fractions of crude oil as the hydrocarbon feedstock. Examples of such feedstocks include vacuum resids, atmospheric resids, aromatic cycle oils, and coker distillates. The hydrocarbon feedstocks are generally contacted with the catalyst at elevated temperatures and pressures, the exact conditions being dependant upon the particular feedstock and the particular results desired. Typical temperature would be in the range of about 200° F. to about 1000° F., more typically about 500° F. to about 750° F., especially for the higher boiling fractions. The pressures of the reaction zone are typically in the range of about 100 to about 3000 psig, more typically about 1000 to about 2000 psig, especially for the higher boiling fractions.

As indicated, the present invention is also particularly useful in hydrodesulfurization. In hydrodesulfurization, organic sulfur compounds such as acyclic and cyclic sulfides in the gas-oil fraction of crude oil and aromatic sulfur compounds in the coke distillate fraction are passed through a fixed bed catalyst with hydrogen. The sulfur is predominantly converted to $H_2S$ and the hydrocarbon saturation is increased.

The hydrocarbon feedstocks are generally brought into contact with the catalyst at elevated temperatures and pressures, the exact conditions being readily determined by the skilled. Typically temperatures are in the range of 400° F. to 800° F. and pressures are in the range of 100–500 psig.

In such processes as the foregoing the feedback is generally combined with a quantity of hydrogen rich gas. As is known in the art the exact amounts of hydrogen rich gas employed vary depending upon the particular reaction conditions employed, the feedstock employed, and the ultimate result desired.

The composition of the catalyst also varies depending upon the particular results desired. Typically, hydrotreating catalyst includes cobalt and/or molybdenum oxides on alumina, nickel oxide, nickel thiomolybdate, tungsten and nickel sulfides, and vanadium oxide, with the cobalt and molybdenum oxides on alumina generally being the most preferred. Hydrocracking catalyst, in contrast, generally include silica-alumina, preferably crystalline silica-alumina, in admixture with small amounts of transition metals, such as platinum, palladium, tungsten, and nickel. Other catalyst employed in such processes comprise silica-alumina including molybdenum and at least one of cobalt and nickel.

The amines that are employed in the present invention include those amines that have been found to have detergent and/or surfactant activity. Thus, the term amine is intended to include aromatic amines, aliphatic amines, alkyl amines, diamines, polyamines, and primary, secondary, and tertiary amines. Typical examples of what is meant by the term amines include lower alkyl amines such as isopropylamine, tallow amine, dodecylamine, tetradecylamine, octadecylamine, hydrogenated tallow amine, cottonseed oil amine, coconut oil amine, hexadecyl amine, stearyl amine, imidazolines, and octadecylmethyl amine.

A particularly preferred class of amines for use in this invention are the $C_2$ to $C_{24}$ alkyl amines, especially the tertiary-alkyl primary amines of the formula:

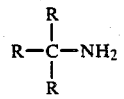

wherein each R is an alkyl group. Secondary-alkyl primary amines in which one of the R-groups is a hydrogen, such as isopropylamine, are also advantageous in accordance with the invention.

An especially preferred group of the tertiary-alkyl primary amines are those in which two of the R groups are lower alkyl groups, usually methyl groups and the other R group is an alkyl radical having 2 or more, preferably 8 to 19 carbon atoms. Tertiary alkyl primary amines which have been found to be eminently suitable for the present invention include those which have been sold under the tradenames "Primene 81-R" and "Primene JM-T". "Primene" is a tradename of the Rohm and Hass Company. Primene 81-R has been reported by its manufacturer to be composed of principally tertiary-alkyl primary amines having 11–14 carbons and a molecular weight principally in the range of 171–213, a specific gravity at 25° C. of 0.813, a refractive index of 1.423 at 25° C., and a neutralization equivalent of 191. Primene JM-T has been reported by its manufacturer to be composed of tertiary-alkyl primary amines having 18–22 carbons with a molecular weight principally in the range of 269–325, a specific gravity at 25° C. of 1.456, and a neutralization equivalent of 315.

The primary component of Primene 81-R is believed to be a compound of the formula:

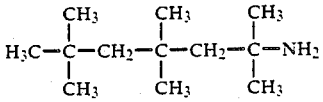

The primary constituent of Primene JM-T has been reported to be essentially the same structure as Primene 81-R, but with 22 carbons.

Typically, the antifoulant would be applied to the catalyst in a diluted form. Generally the antifoulant would be simply included in the feedstock that is being subjected to conversion conditions in the presence of the catalyst bed.

The amount of amine employed can vary over a wide range depending upon the particular amine employed, the type and extent of catalyst fouling, and the degree of improvement desired. Typically the amine would be employed in an amount in the range of from about 0.1 to about 100 ppm by volume based on the volume of the hydrocarbon feedstock charged to the catalyst bed. The optimum amount for the most economical balance can be determined by routine experimentation. It is generally desirable to add the amine to the feedstock in a hydrocarbon diluent. The hydrocarbon diluent may be any suitable normally liquid oil fraction. Generally it is desirable to employ an easily pumpable liquid that is readily miscible with the particular feedstock. Some typical examples include naphtha, kerosene, benzene, toluene, xylene, and BTX.

It has also been found that it is desirable to include in the inventive antifoulant composition at least one alkylaryl sulfonic acid, or salt thereof, of the type known to show detergent or surfactant activity. Typically the alkylsulfonic acids would be those containing a $C_5$ to $C_{18}$ alkyl group. Examples of alkylarylsulfonic acids include dodecylbenzene sulfonic acid, octadecylbenzene sulfonic acid, heptadecylbenzene sulfonic acid, and the like.

The amount of diluent employed will be such that the amine accounts for about 0.5 to about 20 weight percent of the weight of the resulting mixture. The ratio of the amine to the sulfonic acid can vary over a wide range. Typically the molar ratio of the sulfonic acid to the amine would be in the range of about 0.25 to about 2, more preferably about 0.75 to about 1.25. The resulting preferred antifoulant mixture is generally employed in an amount in the range of about 10 to about 200 ppm by volume based on the volume of the hydrocarbon feedstock, more typically about 25 to about 150 ppm by volume.

An embodiment of the present invention that is currently especially preferred uses an admixture of Primene 81-R and Witco 1298 Hard Acid (dodecylbenzene sulfonic acid). Generally, the two are admixed in a suitable diluent, such as described above, to form an antifoulant composition containing about 60 to about 80 weight percent diluent, about 8 to about 20 weight percent Primene 81-R, and 10 to about 20 weight percent Witco 1298, still more preferably about 60 to about 80 weight percent diluent, about 10 to about 16 weight percent Primene 81-R, and about 14 to about 18 weight percent Witco 1298. The currently most preferred antifoulant composition contains about 71 weight percent diluent, about 13 to about 13.5 weight percent Primene 81-R, and about 16 to about 16.5 weight percent Witco 1298.

A further understanding of the present invention and its objects and advantages wll be provided by the following examples.

EXAMPLE I-ANTIFOULANT COMPOSITION

An antifoulant composition referred to hereinafter as Composition A is prepared by admixing 13 weight percent Primene 81-R and 16 weight percent Witco 1298 with 71 weight percent kerosene, wherein the weight percent values are based on the weight of the total antifoulant mixture.

EXAMPLE II-ULTRACRACKER APPLICATION

Antifoulant Composition A is applied to an ultracracker type hydrocracking process in which deposits have already fouled the catalyst beds to such an extent that the pressure buildup is limiting the introduction of the feedstock, i.e. an excessive pressure drop is being observed. It is believed that the primary foulant responsible in this case was iron sulfide.

The antifoulant composition is injected in the recycle oil stream upstream of the recycle oil pump so that it is well mixed with the recycle oil before being brought into contact with the catalyst bed. The antifoulant composition is initially injected into the feed to the first catalyst bed at a rate of about 28 ppm based on the volume of the feedstock being supplied to the catalyst bed. Prior to injecting the antifoulant composition the delta P across the first catalyst bed is 65 psig and the delta P across the whole series of catalyst beds is 164 psig. After 30 hours of hydrocracker unit operation with injection of 28 ppm of Composition A, the delta P across the first bed drops to 31 psig. Thereafter the injection is shifted to another of the unit's reactors. A similar reduction in the pressure drop was obtained in that reactor.

Injecting antifoulant Composition A into the catalyst beds as needed to counter the pressure buildup is estimated to extend the normal run time of this ultracracker process by at least about six months. Thus with the present invention it is possible to obtain acceptable levels of production without interruption for catalyst replacement for about six months longer than normal.

EXAMPLE III-HYDRODESULFURIZATION APPLICATION

In this case the antifoulant Composition A was applied to a dehydrodesulfurization process in which the reactor is fouled by an upset at the coker which results in the deposition of coker fines in the catalyst bed. The initial reactor delta P is 76 psig. After 5 hours of operation of the units with the injection of composition A at a feedrate of 45 ppm based on the volume of the hydrocarbon feedstock, the delta P drops to 70–71 psig.

Thereafter the reactor temperature begins to increase and the delta P begins to increase at a rate of about 2 psig per day. When the delta P reaches 90 psig the addition rate of Composition A increases to 60 ppm. Within a few days the delta P is reduced to 83 psig, indicating that increasing the antifoulant composition is effective in further reducing effects of catalyst foulants. It is concluded that in reactor beds fouled with such heavy accumulations of coke, it will probably be necessary to use higher charges of the inventive antifoulant composition than are needed for less severely contaminated catalyst beds.

EXAMPLE IV-HYDRODESULFURIZATION APPLICATION

In this case, an antifoulant composition consisting of 10 weight percent isopropylamine-dodecylbenzene sulfonic acid (13.5% isopropylamine, 76.5% dodecylbenzene sulfonic acids, and the remainder water and impurities) and 90 weight percent of an aromatic naphtha solvent as diluent is applied to a hydrodesulfurization process at the rate of 30 to 36 ppm. The results are shown in the following table:

TABLE

| Run | Initial ΔP | Final ΔP | Treatment Period |
|---|---|---|---|
| 1 | 44 | 32 | 50 hours |
| 2 | 60 | 53 | 34 hours |
| 3 | 50 | 16 | 60 hours |

As indicated, even rates of introduction of 30–36 ppm significantly reduce ΔP across the reactor bed.

EXAMPLE V

In view of the complexity of the chemical reactions taking place when hydrocarbons are contacted with a catalyst at elevated temperatures, it is not considered possible to understand completely why the present invention provides the results which have been observed. It is, however, theorized that the results may have something to do with the dispersant effects of the amine. To test this theory a study is performed to determine whether the flow of hydrocarbon feed through particulate matter is affected by the presence of the inventive antifoulant composition.

The first test involves the use of 47 mm type A/C glass fibers onto which 10 grams of fouled reactor solids are deposited. The test involves determining the time required for 200 ml of light virgin gas oil (hereinafter referred to as LVGO) to be filtered through the bed of contaminated fibers.

A control run using the LVGO without any antifoulant takes 12.14 minutes to pass through the bed. A run using 25 ppm by volume of Composition A in the LVGO takes only 4.29 minutes. A run using 100 ppm by volume of Composition A in the LVGO takes only 3.50 minutes. This clearly illustrates that the inventive composition improves the flow rate of a hydrocarbon through a contaminated bed of particulate material.

A second test involves the use of a 0.45 micron millipore filter onto which about 2 grams of Celite 24 W (diatomaceous earth) are added. This test involves determining the time required for 200 ml of ultracracker hydrocarbon feedstock to pass through the bed. Again the use of Composition A results in an increased filtering rate.

In still another test a series of runs are made to evaluate the relative effects of the amine and the sulfonic acid. To make this evaluation compositions are prepared using amine or sulfonic acid alone in kerosene in the same concentration that the respective component was present in Composition A. The effect of each of those compositions is then compared to the effect of Composition A on the filtration rate of LVGO through the glass fiber bed which had been treated with 10 grams of fouled hydroprocessor reactor solids.

As noted above untreated LVGO had an average filtering time of 12.14 minutes. The run using 25 ppm of Composition A has a filtering time of 4.29 minutes. The run using 25 ppm of diluent containing only the sulfonic acid has a filtering time of 13.13 minutes and the run using 25 ppm of diluent containing only the amine has a filtering time of 7.55 minutes. This demonstrates that at 25 ppm some sort of synergistic effect is being provided by the amine/sulfonic acid combination.

Results are also obtained using 100 ppm of each of the three compositions. In these runs Composition A gives a filtration rate of 3.50 minutes, the sulfonic acid alone 13.16 minutes, and the amine alone 3.39 minutes. Thus, at 100 ppm, results from using composition A and from using the amine alone, are generally equivalent. It is considered to be especially surprising that the combination of the sulfonic acid with the amine produces highly advantageous results even though the sulfonic acid alone is much less effective than the amine alone. At lower ppm levels, as the 25 ppm runs indicate, a positive synergistic effect appears to be achieved. By using the combination of the amine and the alkylarylsulfonic acid in accordance with the invention, highly advantageous and even synergistic effects can be achieved over a wide range of compositions.

While the present invention has now been described in some detail and for the purposes of illustration some specific embodiments have been described, it should be recognized that many modifications and variations can be made without departing from the scope of the present invention.

What is claimed is:

1. In a process wherein a hydrocarbon-containing feedstock is contacted with a fixed bed of particulate catalyst, a process for reducing the fouling of a catalyst bed by deposits in or on the catalyst bed, comprising contacting the catalyst bed with an effective amount of an antifoulant composition included in the hydrocarbon feedstock, the antifoulant composition comprising at least one alkarylsulfonic acid or salt thereof, comprising a $C_5$ to $C_{18}$ alkyl group and an organic compound of nitrogen consisting essentially of at least one amine soluble in the hydrocarbon containing feedstock.

2. The process of claim 1 wherein the process reduces the rate of increase of pressure drop across the catalyst beds resulting from deposits.

3. The process of claim 1 wherein the process reverses the flow restricting effects of deposits already existing on catalyst in the catalyst bed and reduces the pressure drop across the catalyst bed flow-restricted due to deposits.

4. A process according to claim 1 wherein said feedstock is contacted with said catalyst at a temperature of at least about 500° F.

5. A process according to claim 1 wherein said antifoulant composition comprises at least one $C_8$ to $C_{24}$ aliphatic primary amine as an essential component.

6. A process according to claim 4 wherein said antifoulant compound comprises at least one $C_2$ to $C_{24}$ alkylamine as an essential component.

7. A process according to claim 6 wherein said antifoulant composition further comprises a hydrocarbon diluent.

8. A process according to claim 7 wherein said hydrocarbon diluent consists essentially of kerosene or naphtha.

9. A process according to claim 1 wherein said antifoulant composition further comprises a hydrocarbon diluent.

10. A process according to claim 9 wherein said hydrocarbon diluent consists essentially of kerosene or naphtha.

11. A process according to claim 10 wherein said amine consists essentially of tertiary alkyl primary amines having 11 to 14 carbon atoms per molecule.

12. A process according to claim 11 wherein the molar ratio of said amine to said sulfonic acid is about 1 to 1.

13. A process according to claim 12 wherein said sulfonic acid consists essentially of dodecylbenzene sulfonic acid.

14. A process according to claim 13 wherein said antifoulant composition contains about 60 to about 80 weight percent hydrocarbon diluent, about 8 to about 20 weight percent of said amine, and about 10 to about 20 weight percent dodecylbenzene sulfonic acid.

15. A process according to claim 14 wherein said antifoulant composition is added to said feedstock at a rate in the range of about 25 to about 150 ppm based on the volume of the hydrocarbon feedstock.

16. A process according to claim 15 wherein the feedstock containing said antifoulant composition is contacted with a bed of ultracracker catalyst at a temperature in the range of about 550° F. to about 800° F.

17. A process according to claim 1 wherein said antifoulant composition comprises isopropylamine and dodecylbenzene sulfonic acid.

18. A process according to claim 17 wherein said antifoulant composition is contacted with a bed of hydrodesulfurization catalyst at a temperature in the range of 400° F. to 800° F.

19. A process according to claim 18 wherein said feedstock comprises aromatic recycle oil.

20. A process according to claim 16 wherein said feedstock comprises coker distillate.

21. A process according to claim 6 wherein said amine consists essentially of tertiary alkyl primary amines having 11 to 14 carbon atoms per molecule.

22. A process according to claim 21 wherein said antifoulant composition further includes dodecylbenzene sulfonic acid.

23. A process according to claim 22 wherein the molar ratio of said tertiary alkyl primary amine to the dodecylbenzene sulfonic acid is about 1 to 1.

24. A process according to claim 22 wherein said antifoulant composition comprises dodecylbenzene sulfonic acid as an essential component.

25. A process according to claim 23 wherein said antifoulant composition comprises at least on tertiary alkyl primary amine having 11 to 14 carbon atoms per molecule as an essential component.

* * * * *

UNITED STATES PATENT AND TRADEMARK OFFICE

CERTIFICATE OF CORRECTION

PATENT NO. : 4,921,592

DATED : May 1, 1990

INVENTOR(S) : ALLEN, ET AL

It is certified that error appears in the above--identified patent and that said Letters Patent is hereby corrected as shown below:

Column 8:

Claim 19, line 1, "Claim 18" should read --Claim 16--.

Claim 24, line 1, "Claim 22" should read --Claim 23--.

Claim 25, line 1, "Claim 23" should read --Claim 24--.

Claim 25, line 2, "on" should read --one--.

Signed and Sealed this

Eleventh Day of August, 1992

*Attest:*

DOUGLAS B. COMER

*Attesting Officer*

*Acting Commissioner of Patents and Trademarks*